US006012403A

United States Patent [19]

Codos et al.

[11] Patent Number: 6,012,403

[45] **Date of Patent: *Jan. 11, 2000**

[54] COMBINATION PRINTING AND QUILTING METHOD AND APPARATUS

[75] Inventors: Richard N. Codos, Warren, N.J.; Burl White, Coral Springs, Fla.; Thomas J. Wells, Carthage, Mo.

[73] Assignee: L&P Property Management Company, South Gate, Calif.

[ * ] Notice: This patent is subject to a terminal disclaimer.

[21] Appl. No.: 09/250,352

[22] Filed: Feb. 16, 1999

Related U.S. Application Data

[63] Continuation-in-part of application No. 09/070,948, May 1, 1998, Pat. No. 5,873,315.

[51] Int. Cl.[7] ..... D05B 11/00; D05B 21/00

[52] U.S. Cl. ..... 112/117; 112/470.05; 112/470.13; 112/475.08; 112/475.19; 101/35

[58] Field of Search ..... 112/117, 118, 112/119, 470.05, 470.12, 470.13, 470.06, 470.36, 470.33, 304, 320, 475.08, 475.19; 101/288, 219, 35

[56] References Cited

U.S. PATENT DOCUMENTS

| | | | |
|---|---|---|---|
| 3,611,961 | 10/1971 | Lopez et al. . | |
| 3,960,095 | 6/1976 | Story . | |
| 4,748,920 | 6/1988 | Stutznacker . | |
| 4,785,750 | 11/1988 | Best . | |
| 4,860,675 | 8/1989 | Brower et al. . | |
| 4,953,485 | 9/1990 | Brower et al. . | |
| 5,018,416 | 5/1991 | Freermann . | |
| 5,022,323 | 6/1991 | Schultheis | 101/219 |
| 5,040,473 | 8/1991 | Zesch et al. . | |
| 5,095,835 | 3/1992 | Jernigan et al. . | |
| 5,099,773 | 3/1992 | Codos . | |
| 5,144,899 | 9/1992 | Allen | 112/475.19 X |
| 5,154,130 | 10/1992 | Gribetz et al. . | |
| 5,544,599 | 8/1996 | Frazer et al. . | |
| 5,685,250 | 11/1997 | Kaetterhenry et al. . | |
| 5,873,315 | 2/1999 | Codos . | |

*Primary Examiner*—Peter Nerbun
*Attorney, Agent, or Firm*—Wood, Herron & Evans, L.L.P

[57] ABSTRACT

A quilting machine is provided having a quilting station and a printing station located upstream of the quilting station, with a conveyor extending through each of the stations to convey a web of quilting material through the machine. At the printing station a top layer is printed with a multi-colored design under the control of a programmed controller, which may vary the design from section to section of the web so that individual or small quantities of panel sections of the web may be decorated with a different pattern. The conveyor preferably moves the quilting material relative to stationary heads, but the conveyor may alternatively stop at various stations and the printing or quilting heads moved relative to the stationary web on the conveyor. Precise longitudinal position information is maintained of the location of the printed pattern. The conveyor then conveys the top patterned layer web through a drying station. After bringing the top layer web together with webs of filler and backing material, the conveyor conveys the multi-layered web to the quilting station where a quilted pattern is caused by the controller to be sewn on the printed pattern bearing material in registration with the printed pattern. Preferably, printing is applied before the quilting, but quilting before printing can be accomplished according to certain aspects of the invention. A cutoff station separates the web panels bearing composite printed and quilted patterns under control of the programmed controller. For mattress cover manufacture, border panels can be quilted and printed in coordination with the top and bottom mattress panels, as part of the same webs of material from which they are then severed in a separate synchronously controlled border making section.

21 Claims, 4 Drawing Sheets

COMBINATION PRINTING AND QUILTING METHOD AND APPARATUS

This is a continuation-in-part of the and commonly assigned U.S. patent application Ser. No. 09/070,948, filed May 1, 1998, U.S. Pat. No. 5,873,315 hereby expressly incorporated by reference herein.

FIELD OF THE INVENTION

The present invention relates to the quilting, and particularly to the quilting of patterns on multiple layer materials such as mattress covers, comforters, bedspreads and the like, especially composite patterns in which the overall appearance of the quilted product includes a combination of printed and quilted features.

BACKGROUND OF THE INVENTION

Quilting is a special art in the general field of sewing in which patterns are stitched through a plurality of layers of material over a two dimensional area of the material. The multiple layers of material normally include at least three layers, one a woven primary or facing sheet that will have a decorative finished quality, one a usually woven backing sheet that may or may not be of a finished quality, and one or more internal layers of thick filler material, usually of randomly oriented fibers. The stitched patterns maintain the physical relationship of the layers of material to each other as well as provide ornamental qualities. In quilting, two different approaches are generally used.

Single needle quilters of the type illustrated and described in U.S. patent application Ser. No. 08/497,727, filed Jun. 30, 1995 and entitled Quilting Method and Apparatus, hereby expressly incorporated by reference herein, and those patents cited and otherwise referred to therein are customarily used for the stitching of most comforters, some bedspreads and other products from preformed or precut rectangular panels. Some single needle quilters are used to quilt patterns on fabric that carries a pre-woven or printed pattern, with the quilting adding to or enhancing the appearance of the pattern. Such quilters require that pre-patterned material be manually positioned in the quilting apparatus so that the quilting can be registered with the pre applied pattern or a complicated visual positioning system be used. With such systems, border quilting or coarse pattern quilting can be achieved but high quality outline quilting around the pre applied patterns or the quilting of pattern details of a fraction of an inch in scale are difficult to achieve. Single needle quilters are usually lock stitch machines.

Multiple needle quilters of the type illustrated in U.S. Pat. No. 5,154,130, hereby expressly incorporated by reference herein, are customarily used for the stitching of mattress covers, some bedspreads and other such products which are commonly formed from multi-layered web fed material. These multi-needle quilters include banks of mechanically ganged needles that sew multiple copies of a recurring pattern on the fabric. With such multi-needle machines, the combining of quilting with pre-applied printed or woven patterns in the fabric which would require registration of the quilting with the pre-applied patterns is usually not attempted. Multi-needle quilters are usually chain stitch machines.

Another quilting apparatus employing some of the characteristics of both single needle panel type quilters and web fed multi-needle quilters is that disclosed in U.S. patent application Ser. No. 08/831,060, U.S. Pat. No. 5,832,849 to Jeff Kaetterhenry, et al. and entitled Web-fed Chain-stitch Single-needle Mattress Cover Quilter with Needle Deflection Compensation, hereby expressly incorporated by reference herein. Such a machine uses one or more separately controllable single needle heads that apply chain stitches to panels or webs.

The outer layer of material used for mattress covers, often referred to as ticking, is supplied in a variety of colors and preprinted or dyed patterns. Generally, mattress manufacturers who are the customers of the quilted mattress cover manufacturers or quilting machinery manufacturers require a wide variety of ticking material patterns to produce a variety of bedding products. Frequently, small quantities of each of the variety of products must be made to supply their customers' requirements, requiring the maintenance of inventories of a large number of different patterns of ticking material, which involves substantial cost. Further, the need to constantly change ticking supply rolls when manufacturing such a variety of products in small quantities is a major factor in reducing throughput of the mattress making process and delaying production. This problem exists in the manufacture of bedspreads, comforters and other quilted products where a variety of products in small quantities is desired.

There exists a need in mattress cover manufacturing for a capability of efficiently producing small quantities of quilted fabric such as mattress covers, comforters, bedspreads and the like where different pre-applied patterns on the product are desired to be enhanced by combining the pre-applied and quilted patterns, particularly where combinations of quilted patterns and printed or other pre-applied patterns must vary with each or every few products.

SUMMARY OF THE INVENTION

An objective of the present invention is to provide mattress cover manufacturers with the ability to produce quilted products having a wide variety of patterns that include both quilting and printed or other images or designs without the need to inventory material in a large number of different pre-applied designs.

A further objective of the invention is to provide for the intricate outline or other coordinated quilting of designs or patterns on multi-layered materials in a highly efficient, economical, high speed and automated manner, particularly by both applying the printed design or pattern and quilting the outline or other coordinated quilted enhancement of the printed design or pattern in sequence on the same manufacturing line.

Another objective of the present invention is to efficiently provide for customizable printed and quilted patterns on mattress covers, bedspreads and the like, which can be varied on an individual piece basis or with among items produced in small quantities.

It is a particular objective of the present invention to reduce quilting downtime due to the need to make ticking or other material changes.

It is a more particular objective of the present invention to provide a quilting method and apparatus with which quilted patterns and printed patterns may be applied in registration and varied on a quilting machine.

According to the principles of the present invention, printed designs and coordinated quilted patterns are applied upon multilayered material in the same production line and under the control of a common machine and pattern controller. Multiple layers of the material for the forming a quilt are supported on a frame on which a printing head and a quilting head are also mounted. A mechanism is provided to impart relative movement of the supported material relative to the quilting and printing heads. Such a mechanism can include a material conveyor that moves the material with respect to the frame, and/or head transport mechanisms that move the heads to and from the material when it is fixed relative to the frame. Either the supported material or the heads or both are moved relative to each other under the control of a programmed computer control to apply printed designs and quilted patterns to the material in mutual registration. Preferably, the printed designs are applied first onto the top layer or facing material, then a pattern is quilted in registration with the printed designs. Alternatively, printed designs can be applied after the patterns are quilted.

According to certain preferred embodiments of the present invention, a quilting apparatus is provided with a supply of multiple layers of material to be quilted and printed with a combination printed design and quilt pattern. An outer or top layer is fed, preferably as a continuous web, through a series of stations. At one station, a printed design is applied to the top or facing layer of material. At another station, preferably downstream of the printing station, a quilted pattern is applied to the multiple layered fabric of material including the facing material layer and filler and backing material layers. Whichever pattern or design is applied second, preferably the quilted pattern, it is applied in registration with the pattern or design that has been applied first to the fabric under the control of a programmed controller. A curing station or oven may be further provided downstream or as part of the printing station to cure the dye or ink applied at the printing station.

In the preferred apparatus, a printing station is provided on a frame and quilting station is located on the frame, preferably downstream from the printing apparatus. A material conveyer is provided that brings fabric printed at the printing station into the quilting station with the location of the printed pattern known so that one or more quilting heads at the quilting station can be registered with the printed pattern.

According to one preferred embodiment of the invention, the printing station includes one or more ink-jet printing or dye transfer heads moveable under computer control over the outer or facing layer of material. Additional layers of material are combined with the outer layer, preferably downstream of the printing station and after a printed pattern is applied to the outer layer at the printing station. In this embodiment, the quilted pattern is then quilted onto the material in registration with the printed pattern. Registration is preferably achieved by maintaining information in a controller of the location of the printed pattern on a facing material and of the relative location of the heads with respect to the facing material.

In certain preferred embodiments where the material is moved on a conveyor successively through the printing and quilting stations, information of the location of the design or pattern on the facing material and of the material on the conveyor is maintained by the controller. The material may be fed in separate precut panel sections, as continuous patterns and designs along a web, or in discrete panel sections along a continuous web.

Where the printed design is applied before the quilting, which is preferred, information of the exact location of the design on the facing material is maintained as the material moves from the printing station, as the filler and backing layers of material are brought into contact with the outer layer or facing material, and as the material is fed to the quilting station. For example, outline quilting the pattern in computer controlled registration with the printed pattern can be carried out, or some other quilting pattern can be applied, based on the maintained registration information of the pattern on the web moving through the apparatus.

In one preferred embodiment of the invention, exact registration between the design that is printed onto the material and the pattern that is quilted on the material is maintained by holding a panel section of the multi-layered material onto which the pattern is printed in some securing structure at and between the printing and quilting stations. The panel section can be a separate panel or a portion of a web of material, and may be secured in place on a conveyor. In such an embodiment, the registration may be maintained throughout the entire printing and quilting operation by side securements such as, for example, a pin-tentering material transport that keeps the material fixed relative to the conveyor or securing structure through the printing process and the quilting process. A programmed or process controller controls the relative movement of the fabric and printing and quilting heads, and coordinates the movement in synchronization with printing head control and quilting head control so that the printed and quilted patterns are applied in precise registration.

In certain embodiments of the invention, vision systems may be employed to determine or verify the location of the printed pattern and to enhance or provide registration of the quilting with the printing, in addition or in the alternative to the computer control of the material transport.

In the preferred embodiments of the invention, printed patterns or designs and the quilted patterns are programmed or stored in memory and, in a programmed or operator selected manner, printed designs and quilted patterns may be combined in different combinations to produce a wide variety of composite printed and quilted patterns.

In alternative embodiments, the material may be held stationary, rather than moved relative to a fixed frame, and the printing and quilting heads of the respective printing and quilting stations may move relative to the frame and the material fixed on the frame, under the coordination of a controller, to bring first one head then the other into position over the portion of the material on which a combination of printed design and quilted pattern is to be applied. In most applications, quilting a pattern after applying a printed design is preferred. However, aspects of the invention can be utilized to print designs onto material after quilting the material.

In the manufacture of mattress covers, printed and quilted top and bottom panels can be produced along with strips of border fabric that are to cover the border, including the sides and the head and foot, of a mattress. Such border panels can be produced with coordinated printed designs and patterns that match or correspond to the top and bottom panels. This can be achieved according to one embodiment of the invention by printing and quilting a strip of fabric along a width of the same web material of which the top and bottom panels are being made. The border panel printing and quilting are carried out under the control of a programmed controller, preferably the same controller that coordinates the application of the printed designs and quilted patterns on the top and bottom panels. The border panels so made are then cut or slit from the web that carries the top and bottom panels.

As an alternative to forming border panels out of the same web as the top and bottom panels, a separate but smaller machine having separate quilting and printing stations may be provided adjacent and linked to the main machine on which the mattress top and bottom panels can be applied. The separate machine is supplied with material for forming the border panels that is narrower than, but matches, the material supplied to the main machine for forming the top and bottom panels. Both machines are controlled by the same controller or a controllers that are in communication with each other to coordinate the making of the mattress cover units or batches of units with matching or coordinated top, bottom and border panels. Border panels are of different widths, corresponding to mattresses of different thicknesses, and are of a length equal to the periphery of the mattress rather than the length of the mattress. In addition, border panels have thinner fill layers, being in the range of from ¼ to ½ inches thick, where the top and bottom panels are usually from ½ inch to 3 or 4 inches thick. For these reasons, the embodiment using the separate border panel machine is preferred in that it provides for more efficient use of different lengths of material and provides less process complexity.

The present invention provides the ability to change printed patterns in the course of a quilting run, and to change both printed and quilted patterns to produce quilted products in a wide variety of composite patterns. With the invention, the number of base cloth supplies required to provide pattern variety is greatly reduced, saving substantial costs to the quilted product manufacturer. With the invention, the appearance of the outer layer can be embellished to provide variety and detail, and outline quilting can be carried out in high quality and in close proximity to the printed design. Further, with the invention, these advantages are available with both single needle and multiple needle quilters.

These and other objects of the present invention will be more readily apparent from the following detailed description of the drawings.

DETAILED DESCRIPTION OF THE PREFERRED EMBODIMENT

Figure 1:
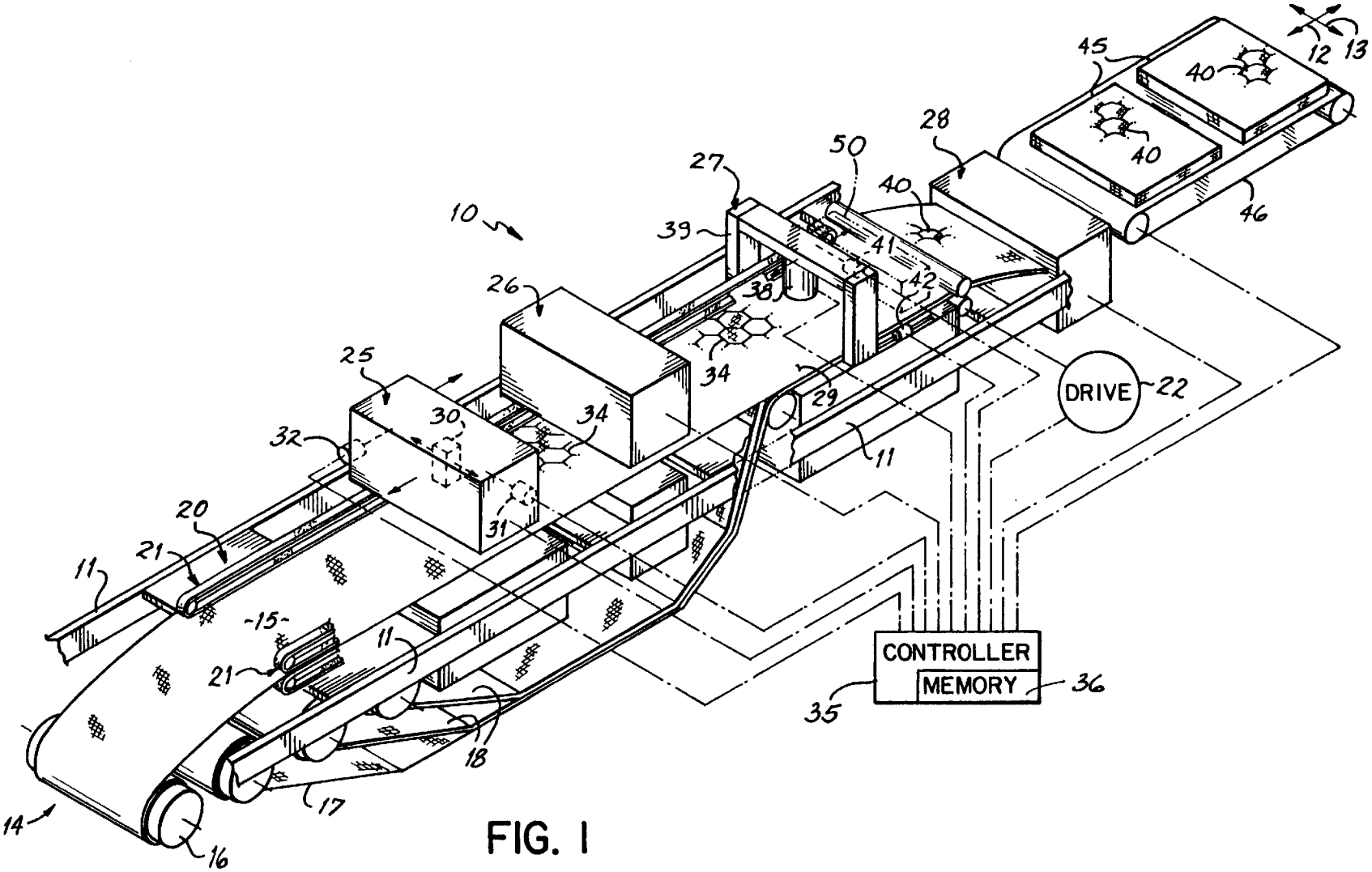
FIG. 1 is a diagrammatic perspective view of a one embodiment of a web-fed mattress cover quilting machine embodying principles of the present invention.

FIG. 1 illustrates a quilting machine 10 having a stationary frame 11 with a longitudinal extent represented by arrow 12 and a transverse extent represented by arrow 13. The machine 10 has a front end 14 into which is advanced a web 15 of ticking or facing material from a supply roll 16 rotatably mounted to the frame 11. A roll of backing material 17 and one or more rolls of filler material 18 are also supplied in web form on rolls also rotatably mounted to the frame 11. The webs are directed around a plurality of rollers (not shown) onto a conveyor or conveyor system 20, each at various points along the conveyor 20. The conveyor system 20 preferably includes a pair of opposed pin tentering belt sets 21 which extend through the machine 10 and onto which the outer layer 15 is fed at the front end 14 of the machine 10. The belt sets 21 retain the web 15 in a precisely known longitudinal position thereon as the belt sets 21 carry the web 15 through the longitudinal extent of the machine 10, preferably with an accuracy of 0 to ¼ inch. The longitudinal movement of the belt 20 is controlled by a conveyor drive 22. The conveyor 20 may take the alternative forms including but not limited to opposed cog belt side securements, longitudinally moveable positive side clamps that engage and tension the material of the web 15 or other securing structure for holding the facing material web 15 fixed relative to the conveyor 20.

Along the conveyor 20 are provided three stations, including a printing station 25, a drying station 26, a quilting station 27 and a panel cutting station 28. The backing material 17 and filler material 18 are brought into contact with the top layer 15 between the drying station 26 and the quilting station 27 to form a multi-layered material 29 for quilting at the quilting station 27. Preferably, the layers 17 and 18 are not engaged by the belt sets 21 of the conveyor 20 but rather are brought into contact with the bottom of the web 15 upstream of the quilting station 27 to extend beneath the web 15 through the quilting station 27 and between a pair of pinch rollers 44 at the downstream end of the quilting station 27. The rollers 44 operate in synchronism with the belt sets 21 and pull the webs 17 and 18 through the machine 10 with the web 15.

The printing station 25 includes one or more printing heads 30 that are transversely moveable across the frame 11 and may also be longitudinally moveable on the frame 11 under the power of a transverse drive 31 and an optional longitudinal drive 32. Alternatively, the head 30 may extend across the width of the web 15 and be configured to print an entire transverse line of points simultaneously onto the web 15. The head 30 is provided with controls that allow for the selective operation of the head 30 to selectively print two dimensional designs 34 of one or more colors onto the top layer web 15. The drive 22 for the conveyor 20, the drives 31 and 32 for the print heads 30 and the operation of the head 30 are program controlled to print patterns at known locations on the web 15 by a controller 35, which includes a memory 36 for storing programmed patterns, machine control programs and real time data regarding the nature and longitudinal and transverse location of printed designs on the web 15 and the relative longitudinal position of the web 15 in the machine 10.

The drying station 26 is fixed to the frame 11. The drying station may be of whatever configuration is suitable to effectively dry the dye being applied at the printing station 25. It may operate continuously or be selectively controlled in accordance with the pattern, as is appropriate. While the print head 30 is preferably a digital dot printer in which the coordinates of each dot of the image printed is capable of being precisely located on the web 15 and relative to the conveyor 20, screen printed, roll printed or other types of printed images may be used while still realizing some of the advantages of the invention.

The quilting station 27 is, in the preferred embodiment, a single needle quilting station such as is described in U.S. patent application Ser. No. 08/831,060 to Jeff Kaetterhenry, et al. and entitled Web-fed Chain-stitch Single-needle Mattress Cover Quilter with Needle Deflection Compensation, which is expressly incorporated by reference herein, now U.S. Pat. No. 5,832,849. Other suitable single needle type quilting machines with which the present invention may be used are disclosed in U.S. patent applications Ser. Nos. 08/497,727 and 08/687,225 and both entitled Quilting Method and Apparatus, expressly incorporated by reference herein, now U.S. Pat. Nos. 5,640,916 and 5,685,250, respectively. The quilting station 27 may also include a multi-needle quilting structure such as that disclosed in U.S. Pat. No. 5,154,130, also expressly incorporated by reference herein. In FIG. 1, a single needle quilting head 38 is illustrated which is transversely moveable on a carriage 39 which is longitudinally moveable on the frame 11 so that the head 38 can stitch 360° patterns on the multi-layered material 29.

The controller 35 controls the relative position of head 38 relative to the multi-layered material 29, which is maintained at a precisely known position by the operation of the drive 22 and conveyor 20 by the controller 35 and through the storage of positioning information in the memory 36 of the controller 35. In the quilting station 27, the quilting head 38 quilts a stitched pattern in registration with the printed pattern 34 to produce a combined or composite printed and quilted pattern 40 on the multi-layered web 29. This may be achieved, as in the illustrated embodiment by holding the assembled web 29 stationary in the quilting station 27 while the head 38 moves both transversely, under the power of a transverse linear servo drive 41, and longitudinally on the frame 11, under the power of a longitudinal servo drive 42, to stitch the 360° pattern by driving the servos 41 and 42 in relation to the known position of the pattern 34 by the controller 35 based on information in its memory 36. Alternatively, the needles of a single or multi-needle quilting head may be moved relative to the web 29 by moving the quilting head 38 only transversely relative to the frame 11 while moving the web 29 longitudinally relative to the quilting station 27, under the power of conveyor drive 22, which can be made to reversibly operate the conveyor 20 under the control of the controller 35.

In certain applications, the order of the printing and quilting stations 25 and 27 can be reversed, with the printing station 25 located downstream of the quilting station 27, for example the station 50 as illustrated by phantom lines in FIG. 1. When at station 50, the printing is registered with the quilting previously applied at the quilting station 27. In such an arrangement, the function of the curing station 26 would also be relocated to a point downstream of both the quilting station 27 and printing station 50 or be included in the printing station 50, as illustrated.

The cutoff station 28 is located downstream of the downstream end of the conveyor 20. The cutoff station 28 is also controlled by the controller 35 in synchronism with the quilting station 27 and the conveyor 20, and it may be controlled in a manner that will compensate for shrinkage of the multi-layered material web 29 during quilting at the quilting station 27, or in such other manner as described and illustrated in U.S. Pat. No. 5,544,599 entitled Program Controlled Quilter and Panel Cutter System with Automatic Shrinkage Compensation, hereby expressly incorporated by reference herein. Information regarding the shrinkage of the fabric during quilting, which is due to the gathering of material that results when thick filled multi-layer material is quilted, can be taken into account by the controller 35 when quilting in registration with the printed pattern 34. The panel cutter 28 separates individual printed and quilted panels 45 from the web 38, each bearing a composite printed and quilted pattern 40. The cut panels 45 are removed from the output end of the machine by an outfeed conveyor 46, which also operates under the control of the controller 35.

Figure 2:
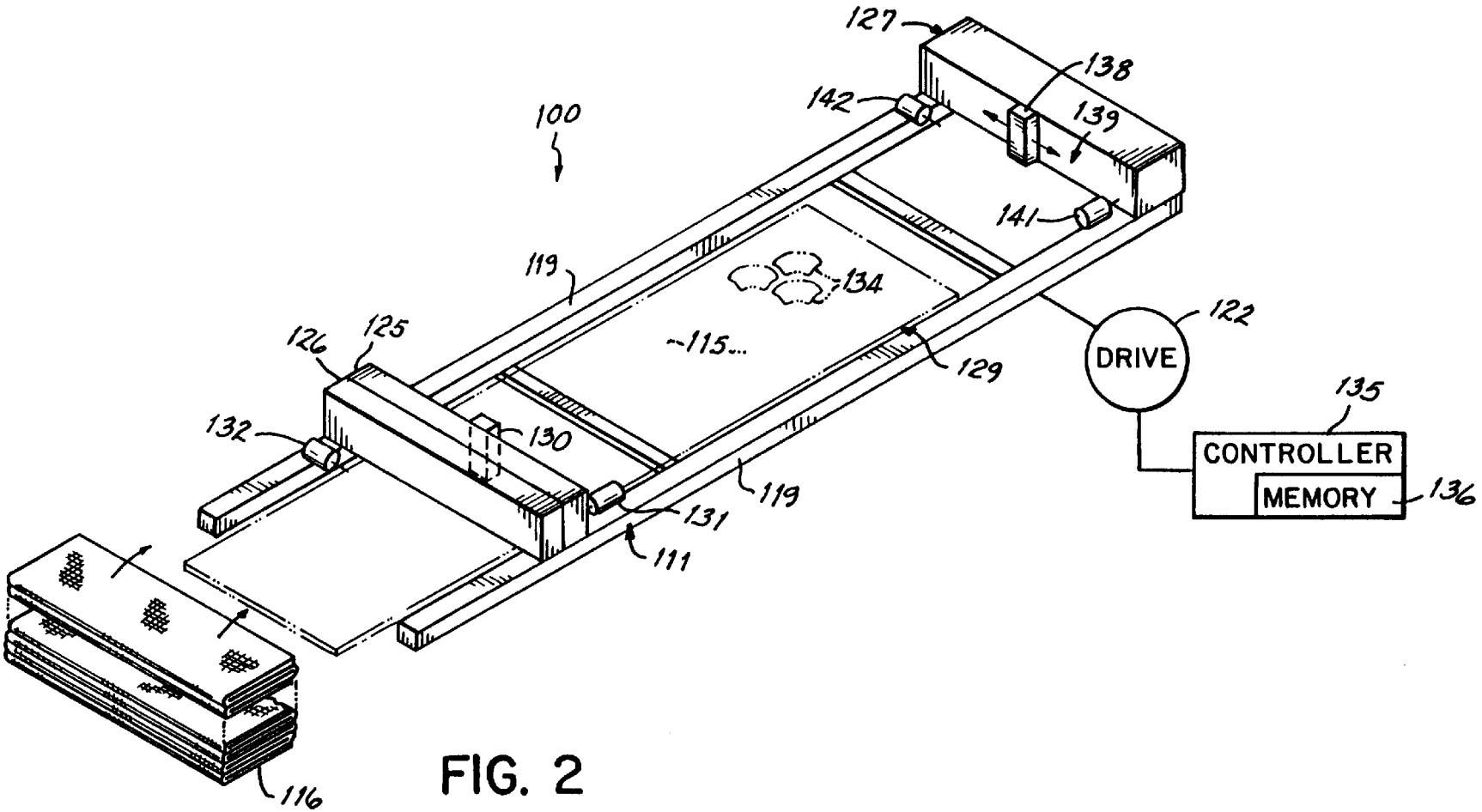
FIG. 2 is a diagrammatic perspective view of a discrete panel quilting machine which is an alternative embodiment to the machine of FIG. 1 that is more suitable for the production of comforters.

FIG. 2 illustrates an embodiment 100 of the invention that which employs a single needle frame supported discrete panel quilting machine such as those described in U.S. Pat. No. 5,832,849. Other machines of that type are disclosed in U.S. Pat. Nos. 5,640,916 and 5,685,250. These single needle quilting machines apply patterns to precut panels and are useful for manufacturing comforters, for example. The machine 100 has an operator accessible stack 116 of preformed panels from which the panel 129 is taken and loaded into the machine 100. A conveyor or conveyor system 120 moves a set of panel supporting edge clamps or other edge securements 121 to bring the panel 129 into a fixed position for application of a combination pattern by printing onto the outer top layer 115 of the multilayered fabric 129 and by quilting the multilayered fabric 129.

In the embodiment 100, a printing station 125, which includes a combined drying station 126 and a quilting station 127 are provided on moveable tracks 119 that are fixed relative to the machine frame 111. The printing station 125 includes one or more printing heads 130 that are transversely moveable across on the moveable station 125 across the frame 111 under the power of a transverse drive 131 and is longitudinally moveable under the power of a longitudinal drive 132. The head 130 is provided with controls that allow for the selective operation of the head 130 to selectively print two dimensional designs 134 of one or more colors onto the top layer 115. The drive 122 for the conveyor 120, the drives 131 and 132 for the print heads 130 and the operation of the head 130 are program controlled to print designs or patterns at known locations on the facing material 115 by a controller 135, which includes a memory 136 for storing programmed patterns, machine control programs and real time data regarding the nature and longitudinal and transverse location of printed designs on the material 115 and the relative position of the panel 129 in the machine 100. The drying station 126 may be moveable with the printing station 125, independently moveable on the frame 111, or fixed to the frame 111 in a position at which it can operate to cure the print medium applied by the printing head 130 without interfering with the printing station 125 or quilting station 127.

The quilting station 127 is, in this embodiment 100, is preferably a single needle quilting station such as is described in U.S. Pat. No. 5,832,849. The quilting station 127 has a single needle quilting head 138 which is transversely moveable on a carriage 139 which is longitudinally moveable on the frame 111 so that the head 138 can stitch 360° patterns on the multi-layered material 129. This is achieved, in the embodiment 100, by holding the panel 129 stationary while the quilting head 138 moves both transversely, under the power of a transverse linear servo drive 141, and the station 127 moves longitudinally on the frame 111, under the power of a longitudinal servo drive 142, to stitch the 360° pattern.

The controller 135 coordinates the motion and operation of the printing station 125 and the quilting station 127 to that one applies a pattern or design panel 129 and then the other applies a coordinated pattern or design in registration. The machine 100 can apply either the printed design first and then register the quilted pattern to it, which is the preferred order, or can apply the quilted pattern first and then register the printed design to the quilted pattern. The controller 135 controls the operation of these stations.

Figure 3:
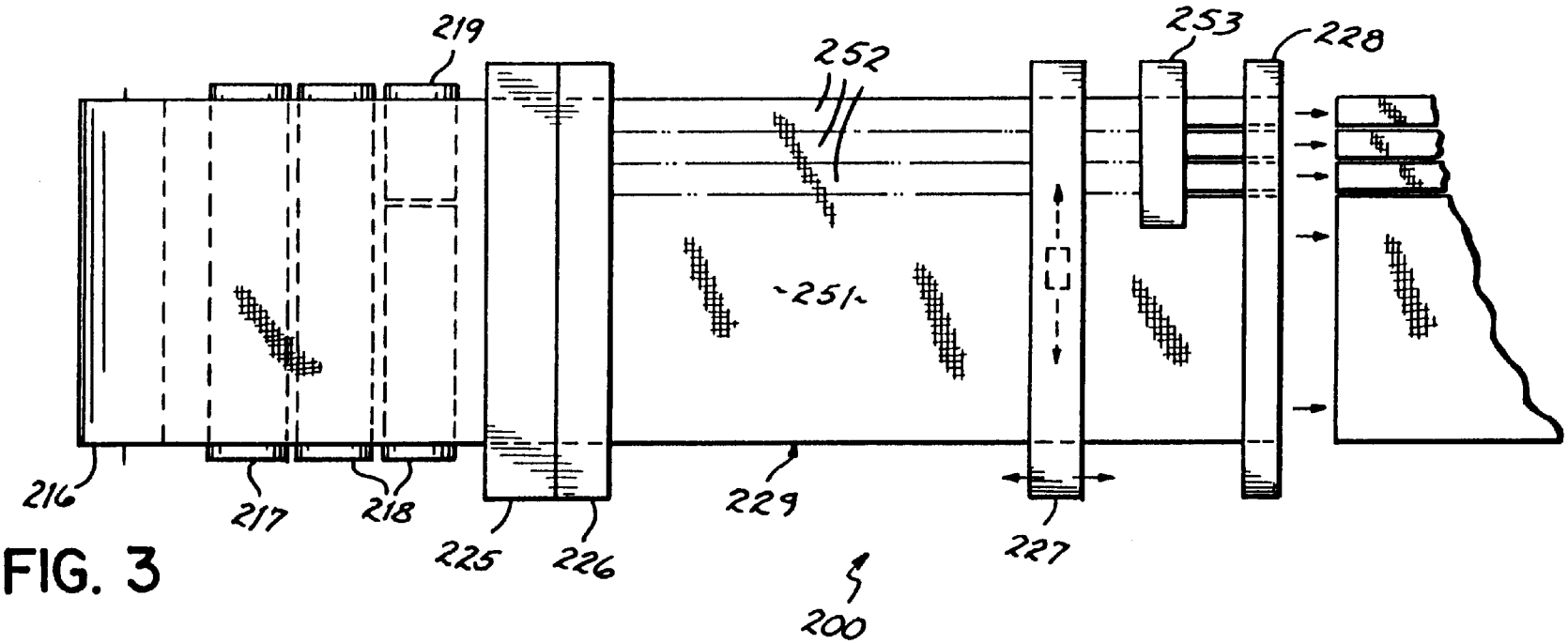
FIG. 3 is a top view of an alternative embodiment of the web-fed mattress cover quilting machine of FIG. 1 that includes structure for making coordinated top and bottom panels and border panels for mattress covers.

FIG. 3 illustrates an embodiment 200 that is similar to the machine 10 of FIG. 1 but further includes the capability to apply combination patterns to different areas of a wide multilayered fabric 229 to produce top or bottom panels 251 with matching border panels 252 of a mattress cover. The machine is provided with supplies 218 and 219 of filler material of different thicknesses at different positions across the width of the facing material 215. The machine 200 is also provided with a slitting station 253 adjacent cutoff station 228, to slit the border panels 252 from the top and bottom panels 251.

Figure 4:
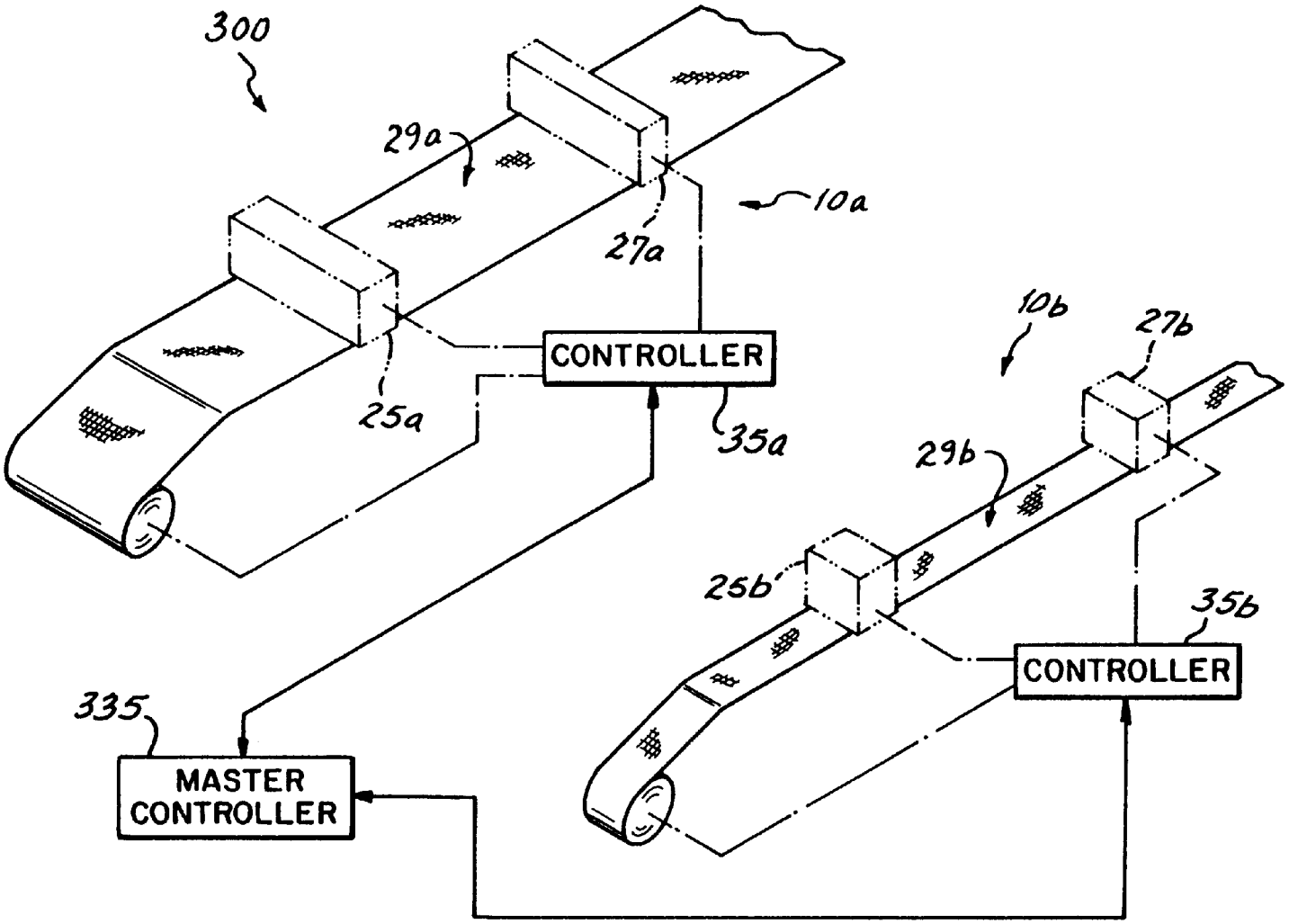
FIG. 4 is a diagrammatic perspective view of an alternative embodiment to the machine of FIG. 3.

FIG. 4 illustrates an alternative and preferred embodiment 300 for producing matching top and bottom panels and border panels for mattress covers. The embodiment 300 includes a machine 10*a* of the type similar to the machine 10 described in connection with FIG. 1 above in combination with a similar narrower version of a machine 10*a*. The machine 10*a* produces the top and bottom panels from multilayered fabric 29*a* that is dimensioned according to the specification for such panels, including a relatively thicker filler layer 118*a* of mattress size width and length. The machine 10*b* produces the matching or coordinated border panels from multilayered 29*b* that is dimensioned according to the specification for border panels, including a relatively thin filler layer 118*b* and narrower width that corresponds to the thickness of a mattress but greater length that corresponds to the perimeter of the border of the mattress. The matching of the combination patterns applied to the fabric 29*a*,29*b* is controlled either by a single controller, by a master controller 335 (as illustrated) which controls separate similar machine controllers 35*a*,35*b* of respective machines 10*a*, 10*b*, with separate controllers of the machines 10*a*, 10*b* linked together such that they work in unison or such that the controller of one machine 10*a*,10*b* controls the other. The controller 35*a* controls the operation of the machine 10*a* to produce combination printed designs and quilted patterns on the top and bottom panels of a mattress with printing head 25*a* and quilting head 27*a*, respectively, as with the machine 10 described above. Controller 35*a* controls the operation of the machine 10*b* to produce matching combination printed designs and quilted patterns on border panels for the same mattress with printing head 25*b* and quilting head 27*b*, respectively. Master controller 335 coordinates the operation of the two controllers 35*a* and 35*b*.

The above description is representative of certain preferred embodiments of the invention. Those skilled in the art will appreciate that various changes and additions may be made to the embodiments described above without departing from the principles of the present invention.

Therefore, the following is claimed:

1. A quilting apparatus for producing in-line a panel section of a multi-layered quilt having a composite of a printed design and a quilted pattern respectively printed and quilted in registration thereon comprising:

a frame;

securing structure on the frame for holding a fabric that includes a layer of facing material;

a quilting station mounted on the frame and having at least one quilting head that has at least one needle and that is moveable at least transversely relative to the frame and both longitudinally and transversely relative a multilayered quilt fabric held by the securing structure;

a printing station mounted on the frame and having at least one printing head operable to print designs on the facing material when held by the securing structure; and a controller programmed to control the relative movement between the securing structure and the at least one printing head, and between the securing structure and the at lease one quilting head, and to control the operation of the printing head and the operation of the quilting head in relation to the position of the fabric held by the securing structure in accordance with programmed print designs and quilt patterns, and to coordinate the heads to produce a composite of a printed design and a quilted pattern on the panel section with the printed design and quilted pattern in mutual registration.

2. The apparatus of claim 1 further comprising:

a conveyor moveable relative to the frame, the securing structure being fixed to the conveyor and configured to hold the fabric fixed relative to the conveyor;

the quilting station being situated along the conveyor such that the at least one quilting head is moveable at least transversely relative to the conveyor;

the printing station being situated along the conveyor and spaced from the quilting station; and the controller being programmed to control the movement of the printing head, the quilting head and conveyor and the operation of the printing head and quilting head in accordance with programmed print designs and quilt patterns, and to coordinate the heads and conveyor to produce a quilt having thereon a composite formed of the design printed by the printing head and the pattern quilted thereon by the quilting head.

3. The apparatus of claim 1 wherein:

the securing structure is configured to hold a section of a web of multilayered quilt fabric and of the facing material.

4. The apparatus of claim 1 wherein:

the securing structure is configured to hold fabric in fixed relation to the frame, and the quilting and printing heads are moveable relative to the frame and relative to the fabric held by the securing structure.

5. The apparatus of claim 1 wherein:

the securing structure moveable relative to the frame and the quilting and printing heads are fixed at least longitudinally relative to the frame, the securing structure being configured to move the fabric at least longitudinally, under the control of the programmed controller, relative to the quilting head to quilt a pattern thereon and relative to the printing head to print a design thereon.

6. The apparatus of claim 1 wherein:

the controller is programmed to control the relative movement between the securing structure and the printing head, and between the securing structure and the quilting head, and to control the operation of the printing head and the operation of the quilting head, to print a design on the facing material with the printing head and to then quilt a pattern on the fabric with the quilting head in registration with the printed design to produce a composite of a printed design and a quilted pattern on a facing material of a quilt.

7. The apparatus of claim 1 wherein:

the controller is programmed to control the relative movement between the securing structure and the printing head, and between the securing structure and the quilting head, and to control the operation of the printing head and the operation of the quilting head to quilt a pattern on the fabric with the quilting head and to then print a design on the facing material with the printing head in registration with the quilted pattern to produce a composite of a printed design and a quilted pattern on the panel section.

8. The apparatus of claim 1 wherein:

the controller is programmed to control the operation of the printing head to print the printed design onto each of a plurality of panel sections of facing material in accordance with a selected design program and to control the operation of the quilting head to quilt the quilted pattern onto each of the plurality of panel sections of fabric that includes the facing material in accordance with a selected pattern program and to control the registration between the printed design and the quilted pattern, the controller being operable to change the printed designs and quilted patterns from panel to panel.

9. The apparatus of claim 1 wherein:

the controller is programmed to control the at least one printing head and the at least one quilting head to produce corresponding top and bottom panel sections of a mattress cover, and to produce similarly corresponding border portion of the mattress panel with a printed design and a quilted pattern.

10. The apparatus of claim 9 wherein:

the controller is programmed to control the at least one printing head and the at least one quilting head to produce corresponding top and bottom panel sections of a mattress cover from a multi-layered quilt fabric, and to produce from contiguous portions of the multi-layered quilt fabric a corresponding border portion of the mattress cover with a printed design and a quilted pattern.

11. The apparatus of claim 9 further comprising:

an auxiliary frame;

border panel securing structure on the auxiliary frame for holding a border panel of fabric having a facing material thereon;

a border quilting station mounted on the auxiliary frame and having at least one border quilting head that has at least one needle and that is moveable both longitudinally and transversely relative to the border panel of fabric held by the border panel securing structure and at least transversely relative to the auxiliary frame;

a border printing station mounted on the auxiliary frame and having at least one border printing head operable to print designs on facing material when held by the border securing structure; and a controller programmed to control the border printing head and the border quilting head to produce a border portion of the mattress panel with a printed design and a quilted pattern that corresponds to the top and bottom panel sections of a mattress cover being produced with the heads of the quilting station and the printing station.

12. A quilting apparatus comprising:

a frame;

a conveyor moveable relative to the frame;

a quilting station located along the conveyor and having at least one needle on at least one quilting head that is moveable both longitudinally and transversely relative to the conveyor;

securing structure for holding a web of facing material fixed relative to the conveyor;

a printing station located along the conveyor spaced from the quilting station and having at least one printing head operable to print designs on the web of facing material;

guides directing the web of facing material onto the conveyor upstream of the printing and quilting stations and directing webs of backing and filling material onto the conveyor upstream of the quilting station; and a controller programmed to control the movement of the printing head, the quilting head and conveyor and the operation of the printing head and quilting head in relation to the position of the conveyor and the location of the web of facing material on the conveyor in accordance with programmed print designs and quilt patterns, and to coordinate the heads and conveyor to produce a composite printed design and quilted pattern on the material with patterns quilted on the material at the quilting station in registration with designs printed on the material at the printing station.

13. The apparatus of claim 12 wherein:

the printing station is located upstream of the quilting station and the controller is programmed to operate the printing head to print designs on the facing material and to operate the quilting head to thereafter quilt patterns on the facing material that are coordinated with designs previously printed thereon by the printing head.

14. The apparatus of claim 12 wherein:

the printing station is located downstream of the quilting station and the controller is programmed to operate the quilting head to print patterns on the facing material and to operate the printing head to thereafter print designs on the facing material that are coordinated with patterns previously quilted thereon by the quilting head.

15. The apparatus of claim 12 further comprising:

a curing station located downstream of the printing station and operable to cure printing media of designs printed on the facing material by the print head.

16. The apparatus of claim 12 wherein:

the printing station is located downstream of the quilting station and the quilting head the controller is programmed to operate the printing head to print designs on the facing material and to operate the quilting head to thereafter quilt patterns on the facing material that are coordinated with designs printed thereon by the printing head.

17. The apparatus of claim 12 wherein:

the printing head is moveable both longitudinally and transversely relative to the conveyor and at least transversely relative to the frame.

18. The apparatus of claim 12 wherein:

the printing head is an ink jet printing head operable to print a design on material at the printing station that is composed of dots printed at programmed locations on the material.

19. The apparatus of claim 12 wherein:

the quilting station includes a single needle quilter and the quilting head is a single needle quilting head moveable relative to the conveyor.

20. The apparatus of claim 12 wherein the quilting station includes a multi-needle quilting station operable to simultaneously chain stitch a plurality of patterns of an array onto material at the quilting station.

21. A quilting method comprising the steps of:

selecting a first print pattern to be printed on the material;

selecting a first quilt pattern to be quilted on the material;

providing a printing head operable to print the selected print pattern onto the material;

providing a quilting head operable to quilt the selected quilt pattern onto the material; and applying the first print pattern to the material with the printing head and applying the first quilt pattern to the material with the quilting head, applying first one pattern and then applying the other by determining the position of the one pattern on the material and controlling a respective head with a controller to apply said other pattern onto the material in registration with the first applied pattern.

* * * * *